US005160816A

United States Patent [19]

Chlop

[11] Patent Number: 5,160,816

[45] Date of Patent: Nov. 3, 1992

[54] TWO DIMENSIONAL SOUND DIFFUSOR

[75] Inventor: Bernard W. Chlop, Poolesville, Md.

[73] Assignee: Systems Development Group, Poolesville, Md.

[21] Appl. No.: 598,403

[22] Filed: Oct. 17, 1990

[51] Int. Cl.[5] ..... E04B 1/82

[52] U.S. Cl. ..... 181/285; 181/286; 181/288; 181/290; 181/293

[58] Field of Search ..... 181/284, 285, 286, 288, 181/290, 293, 198, 295

[56] References Cited

U.S. PATENT DOCUMENTS

| | | | |
|---|---|---|---|
| 3,712,413 | 11/1973 | Eckel | 181/284 |
| 4,244,439 | 1/1981 | Wested | 181/286 X |
| 4,821,839 | 4/1989 | D'Antonio et al. | 181/286 X |
| 4,964,486 | 10/1990 | D'Antonio et al. | 181/285 |
| 4,971,850 | 11/1990 | Kuan-Hong | 181/284 X |

*Primary Examiner*—Michael L. Gellner
*Assistant Examiner*—Khanh Dang
*Attorney, Agent, or Firm*—Stevens, Davis, Miller & Mosher

[57] ABSTRACT

A two-dimensional sound diffusor is composed of a plurality of wells defined by a matrix of projecting elements. The wells, which have different depths and widths, are arranged in a repeating pattern. The boundaries of the wells and of the repeating pattern are defined by projections arranged on a base. The ends of the projections extend away from the base, terminating in an inclined face which is inclined relative to the base by an angle of 10°. The incline may be rotated from one projection to the next, on a plane parallel to the base of the unit by 90° or 180°. This arrangement produces two dimensional sound diffusion.

13 Claims, 7 Drawing Sheets

TWO DIMENSIONAL SOUND DIFFUSOR

FIELD OF THE INVENTION

This invention relates to a two dimensional sound diffusor which will reflect and refract sound over a broad range of frequencies.

BACKGROUND OF THE INVENTION

Sound is generated from a source producing audible waves transmitted outward from the source. A listener in a room with the source receives sound waves directly from the source or indirectly from sound waves being reflected from objects in the room or from the boundaries defining the room. The quality of sound may be altered, and may even be enhanced, by placing physical objects in the path of propagating sound waves. By absorbing, reflecting or diffusing sound waves, the quality of the sound can be enhanced. Absorption of sound waves occurs when a sound wave strikes a barrier that is capable of absorbing the energy of the sound wave. For example, absorption of energy of a sound wave is accomplished by placing in the path of the sound wave energy absorbing materials. For instance, insulation materials of various thicknesses, carpet, acoustic ceiling tile, draperies and other heavy fabrics will absorb energy from sound waves that strike these objects. By this absorption the sound wave will gradually lose energy. If a room is capable of totally absorbing sound then the room is described by the art as being dead. Ideally, a certain degree of energy or sound absorption is acceptable in a listening room to prevent formation .of standing waves. However, the listening room should not be so sound-absorptive that the room becomes dead, or that certain frequencies are lost due to absorption.

Reflection of sound waves occurs by changing the direction of a propagating energy wave without absorption. A hard surface, such as a drywall surface, wood, plaster or cement walls can function as devices for accomplishing reflection. The more dense the flat surfaces are the greater the ability of the surface to reflect sound. A certain amount of sound reflection is also considered desirable for listeners.

Diffusion, which is somewhat more complex than reflection or refraction, is a combination of reflection and refraction of the sound wave at the same time. That is, different segments or different frequencies emanating from a sound source when diffused will be delayed in time due to scattering or reflection of the wave. A sound source generally emits more than a single sound frequency. In diffusion, the different frequencies are reflected and scattered so that different frequencies are delayed in time. By provision of diffusion in a small recording studio, sounds in the studio can be perceived by the listener as being like those associated with a larger room, because the listener is exposed to the reflected, scattered and time delayed sound waves. Diffusor panels, used in the art, generally provide a means for achieving at least one dimensional sound diffusion, i.e., reflection and refraction in one direction.

The two main functional attributes of a diffusor are its spatial response and its temporal response. By design, a diffusor panel can have a defined spatial response, and this response can be represented on a polar response graph. The spatial response represents sound distribution and scattering, and is dependent upon the particular sound frequencies involved. Temporal response is defined as a reaction in time to an impulse. That is, as sound travels into a diffusor panel, any cavities in the diffusor panel cause time delays due to the differing depths of the panel. Total bandwidth of a diffusor panel is defined as the range of frequencies of sound in which the diffusor panel is effective in producing a spatial and temporal response. The temporal response may be defined as the difference between a monitored reflected sound and a monitored diffused sound.

Generally, prior devices have been made of panels with cavities. When used in a sound recording studio, a diffusor will be contacted by propagating sound waves. The sound waves will then be reflected and refracted at different time intervals because of the cavities of the diffusor. In the past, diffusion has been accomplished in a number of ways. Irregular shapes of differing depths have been created by the use of dimensional lumber, stone and brickwork. Diffusors made from these materials are usually custom made and engineered for the space to be affected. Usually, such devices are very costly, requiring many hours of time and expensive materials to produce.

One commercially available device, believed to be that disclosed in U.S. Deign Pat. No. 306,764, accomplishes diffusion by creating wells of equal width separated by dividers. The diffusors are wall- or ceiling-mounted, depending on their intended application or the desired result. However, the dividers used in this device are quite thin and when exposed to low frequencies, the diffusor will function more as a resonator (and, therefore, more as an absorber of sound energy) than a diffusor. This undesirable phenomenon occurs because the dividers do not possess a substantial mass. The dividers also prevent construction of a diffusor having wells of differing width.

SUMMARY OF THE INVENTION

The two dimensional diffusor of the invention is a significant contribution to this art. The sound diffusor of the invention is capable of diffusing sound in both vertical and horizontal directions. The diffusor according to the invention distributes sound energy into a room more evenly than do the prior art devices.

The sound diffusor of the invention is composed of a plurality of wells defined by a matrix of projecting elements. The wells, which have different depths and widths, are arranged in a repeating pattern. The boundaries of the wells and of the repeating pattern are defined by projections arranged on a base. The ends of the projections extend away from the base, terminating in an inclined face which is inclined relative to the base by an angle of 10°. The incline may be rotated from one projection to the next, on a plane parallel to the base of the unit by 90° or 180°. This arrangement produces two dimensional sound diffusion.

DETAILED DESCRIPTION OF THE INVENTION

Figure 1:
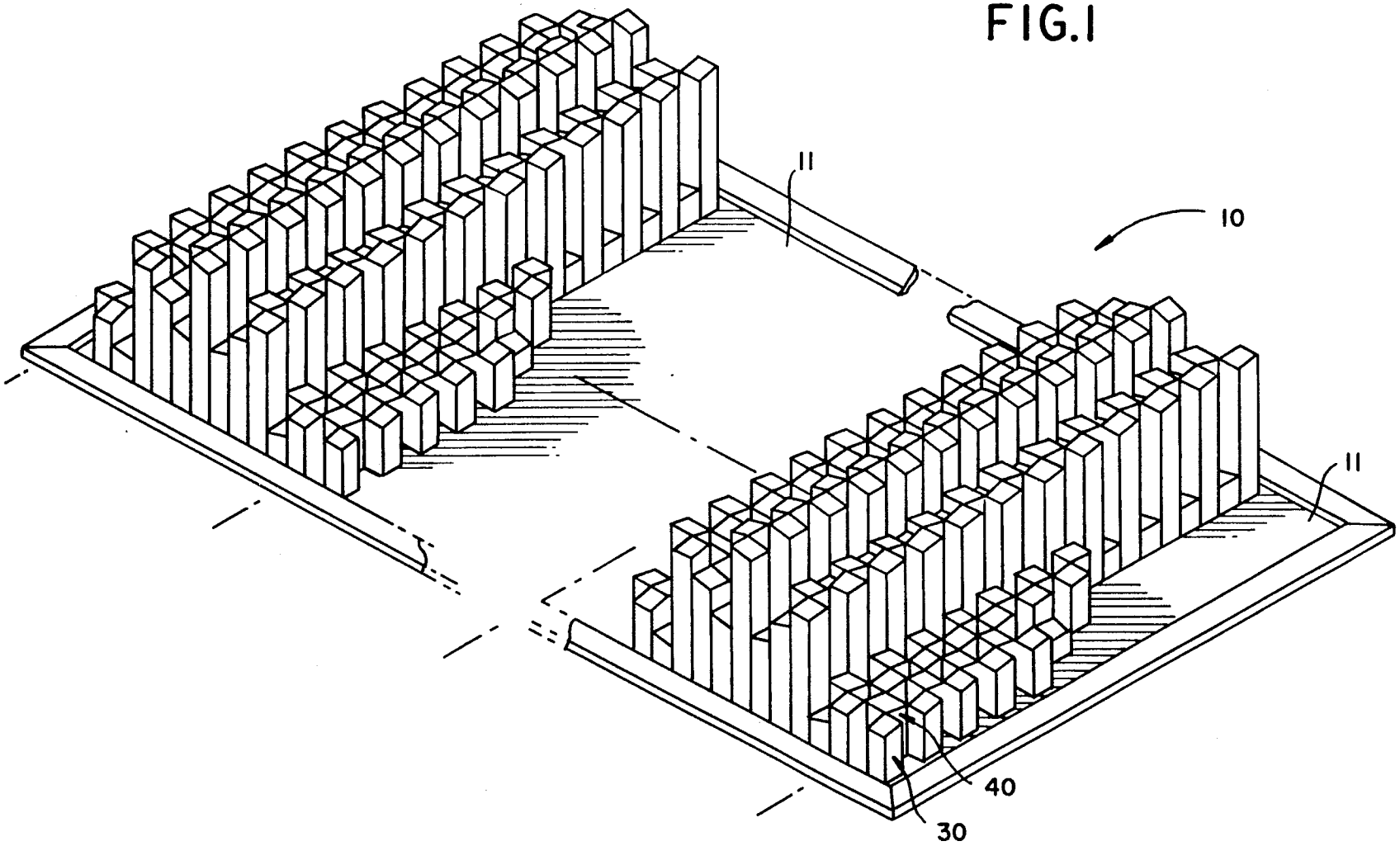
FIG. 1 is a perspective view of an acoustical diffusor according to the present invention.

A sound diffusor 10 is shown in FIG. 1, drawn to scale. The sound diffusor is made up of a plurality of rows of individual projecting elements. The projecting elements each have one of six different lengths, the lengths being multiples of a smallest projecting element size. As seen in FIG. 1, each of the projecting elements has an inclined uppermost surface, and a plurality of cavities are formed between the projecting elements. The inclined uppermost surfaces of the individual projecting elements are inclined in one of four directions. Alternating rows have identical structures, and are interleaved with mirror-image rows.

Figure 2:
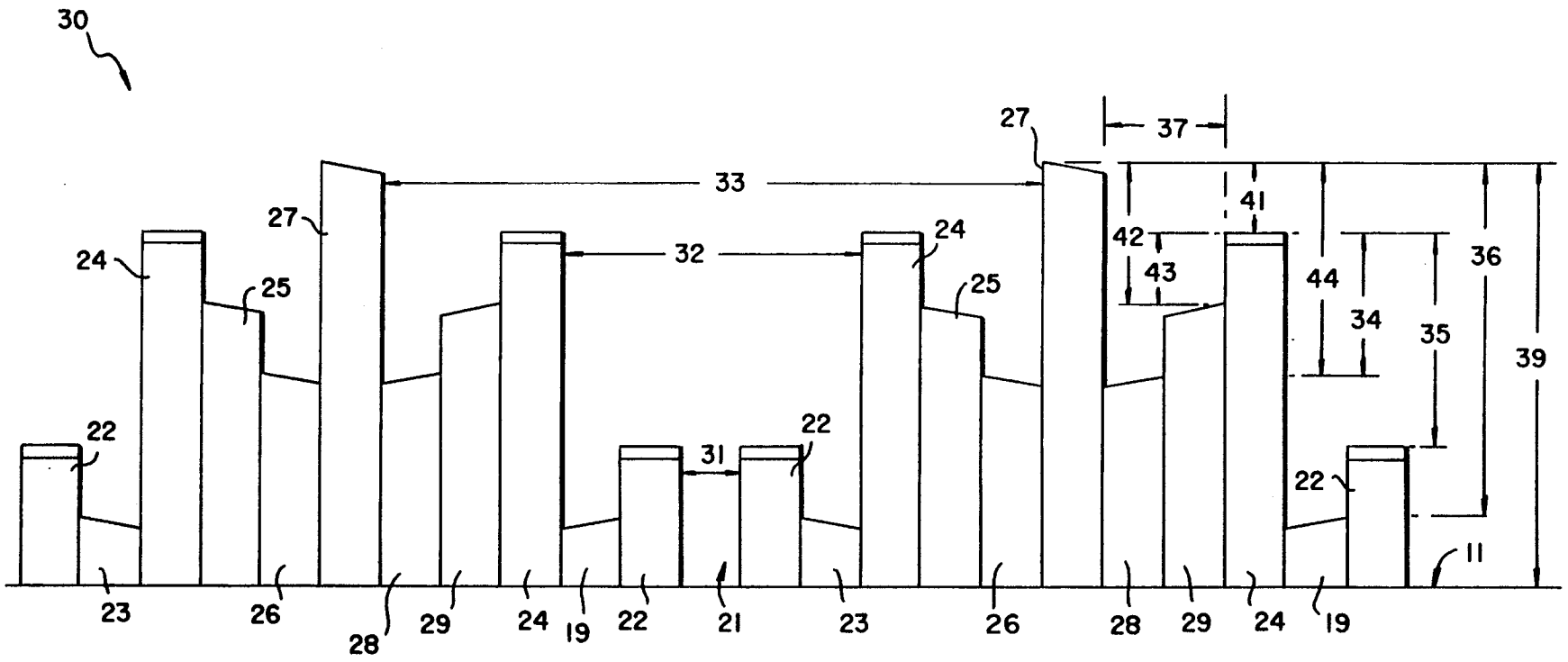
FIG. 2 is a side elevational view showing a row of the diffusor of FIG. 1 having a plurality of aligned projections extending in a horizontal direction.

FIG. 2 is a side elevational view of an arrangement of individual projections, drawn to scale, forming a row 30 according to the invention. From left to right, the projections are in the following sequence, wherein identical numbers indicate identically-sized and identically oriented projecting elements: 22, 23, 24, 25, 26, 27, 28, 29, 24, 19, 22, empty space 21, 22, 23, 24, 25, 26, 27, 28, 29, 24, 19, 22, and another empty space (unnumbered). In this sequence, it can be seen that the group of projecting elements 24, 25, 26, 27, 28, 29, and 24 is repeated on both the left and right sides of the empty space 21. The leftmost elements 22 and 23, and left elements 19 and 22 adjacent the empty space 21 on the left side thereof, however, are mirrored respectively by elements on the right side of the empty space 21, i.e. by elements 22 and 23 adjacent the empty space 21 on the right side thereof and by elements 19 and 22 at the rightmost end of the row 30.

The projections are inclined in the row 30, and are further discussed as follows. The central space 21 exists between two corresponding groups of projections. Bounding the space 21 are identical projections 22, 22 having their uppermost surfaces inclined toward the viewer. In the right hand direction projection 23 is inclined to the right. Next, projection 24 is inclined toward the viewer, projection 25 is inclined toward the right, projection 26 is inclined toward the right, projection 27 is inclined toward the right and projection 28 is inclined toward the left. Adjacent projection 28 is projection 29 which is also inclined toward the left, followed by projection 24 inclined toward the viewer, projection 19 inclined toward the left, and projection 22 which is inclined toward the viewer. Identically numbered projections to the right of the empty space 21 have identical inclinations, and the inclinations of these projections are accordingly not further discussed. The projections are supported upon a base 11, the uppermost surface thereof being indicated in FIG. 2.

Cavities 31, 32, and 33 are indicated in FIG. 2. The cavities are well widths having dimensions which correspond to a particular sound wavelength or fraction of a particular sound wavelength. As can be seen in FIG. 2, the cavities 31, 32, and 33 not only have different widths (as measured in the horizontal direction in FIG. 2) but also have different depths (as measured in the vertical direction), as discussed in the foregoing. For example, the recess 33 has multiple depths 42, 43, 41, 34, 35, 36, and 39. Cavity 37 has depths of 42, 43, and 44, and a cavity 32 has depths of 34 and 35. Many additional such cavities, having various depths, are formed between adjacent ones of the projections and between separated pairs of projections. Since a variety of cavities are defined between various individual projecting elements, a relatively large number of cavities are formed between these projections, accommodating a relatively large number of different fractions of wavelengths of sound including half wavelengths and other fractional wavelengths. Additionally, adjacent rows are staggered so that there are not only horizontally-defined and vertically-defined cavities as are shown in FIG. 2, but there are also a plurality of cavities arranged in a three-dimensional region (of length, width, and depth) which are formed as seen in FIGS. 1 and 3.

Figure 4:
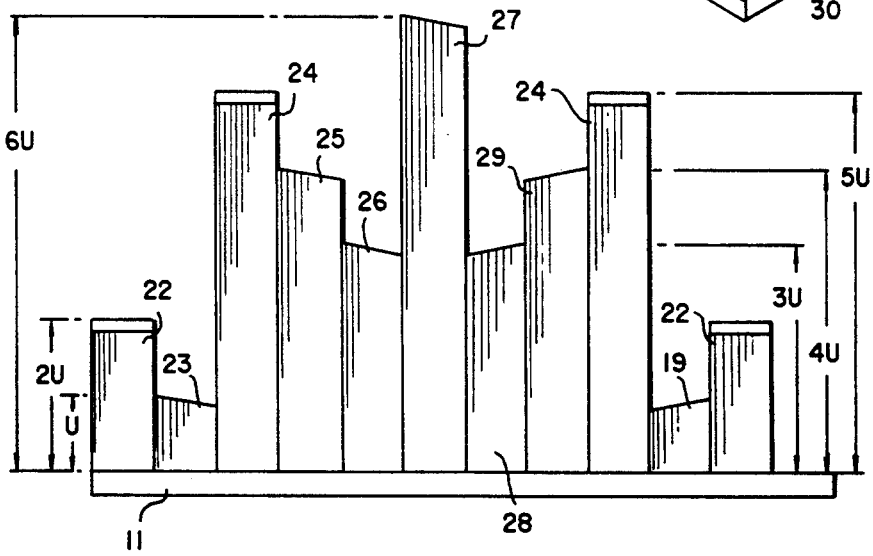
FIG. 4 is a portion of the row of projections shown in FIG. 2.

The unit height of the smallest element 19 or 23 in 1½ inches, and each of the projecting elements are a multiple of this unit height. Since there are six different lengths of projecting elements used for the individual projections, the individual projecting elements have heights of 1½, 3, 4½, 6, 7½, and 9 inches, respectively. The dimension of the individual projecting elements is depicted in FIG. 4 which illustrates the rightmost group of projecting elements in FIG. 2. Individual projecting elements have widths and depths of 1¼ inches, and are preferably cut from square wood stock. The base 11 is preferably a plywood sheet having a thickness of ½ inch. The uppermost surface of each of the projecting elements is inclined. The range of the incline is between 1° and 20° angles preferably 10°. The width of the space 21 of FIG. 2 is also 1½ inches. The base of a projecting element is fastened to the base 11 preferably by wood glue.

Figure 3:
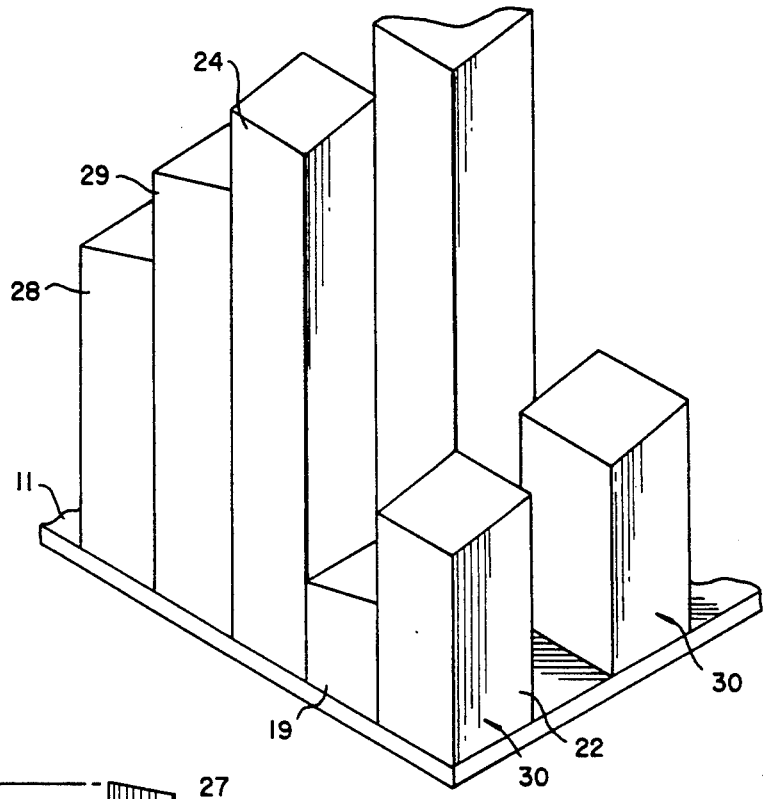
FIG. 3 is an enlarged perspective view of a portion of the acoustical diffusor of FIG. 1.
Figure 6:
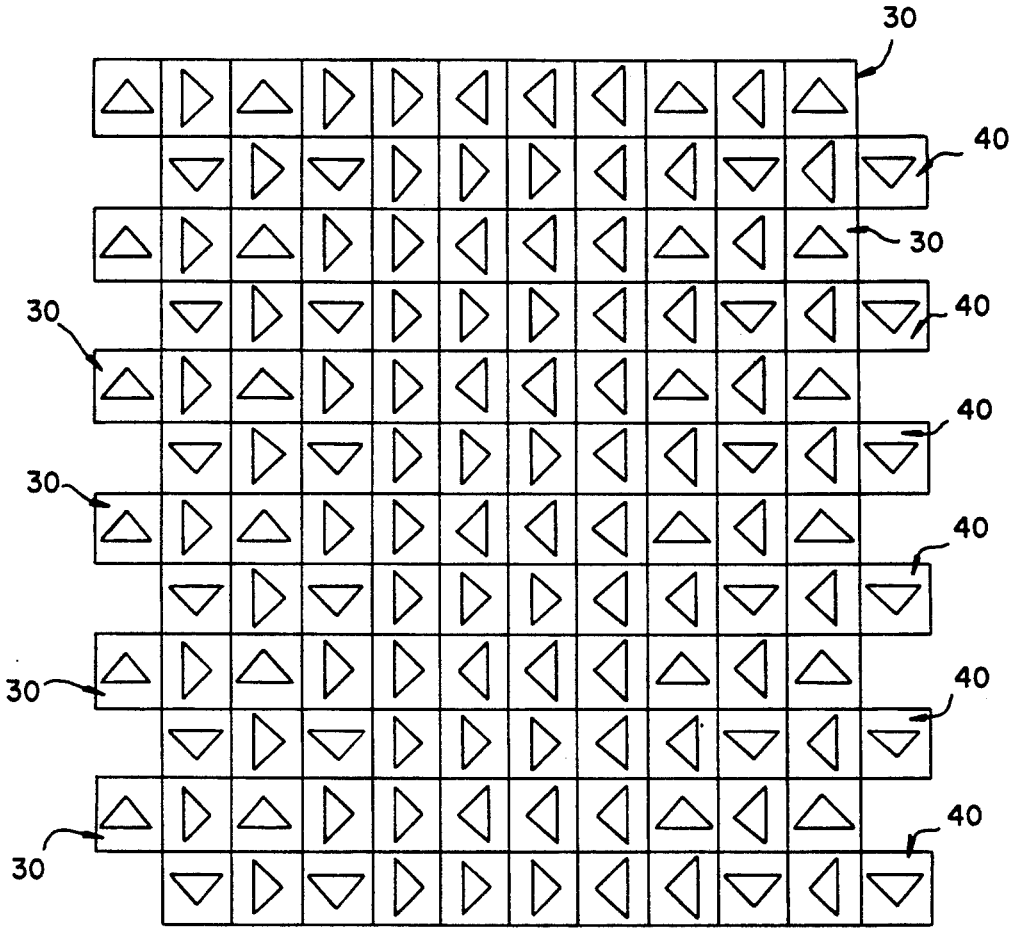
FIG. 6 is a schematic, top elevational view of a half section of the diffusor of FIG. 1, showing the angle of inclination of each projection.

FIG. 3, drawn to scale, is an enlarged perspective view of a portion of the sound diffusor 10 of FIG. 1. Here, individual elements of the row 30 are seen in perspective, in which rows 30 are alternated with intervening rows 40 (as shown in FIGS. 1 and 6). The row 40 is formed as a reversal of the row 30, and is staggered by one unit, as discussed further hereunder with respect to FIG. 6.

Figure 5:
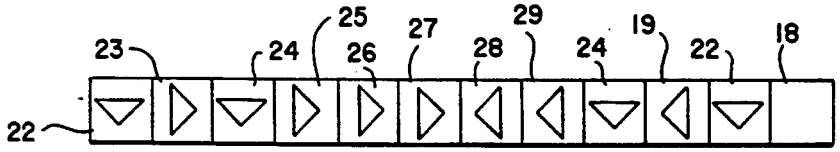
FIG. 5 is a plan view of the portion of the row of projections shown in FIG. 4 showing the direction of a slope of an inclined top portion of each projection.
Figure 7A:
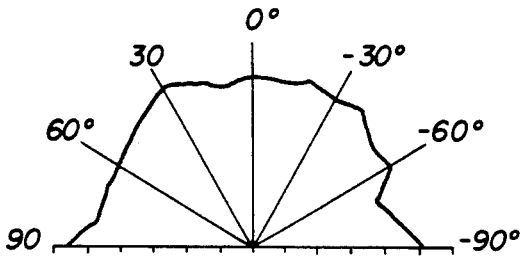
FIG. 7A–7F are horizontal polar plots of the amplitude of sound waves diffused after striking the sound diffusor according to the invention, in which the initial sound wave strikes the diffusor of FIG. 1 at an angle of 0° incidence.
Figure 7B:
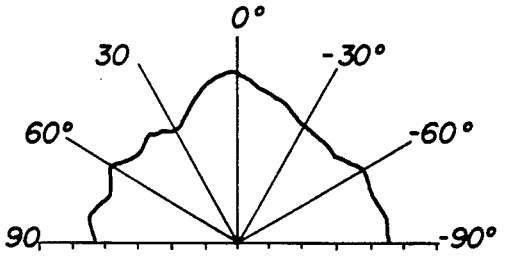
Figure 7C:
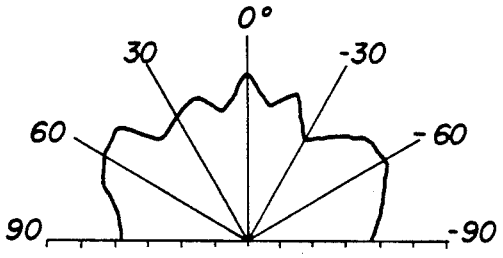
Figure 7D:
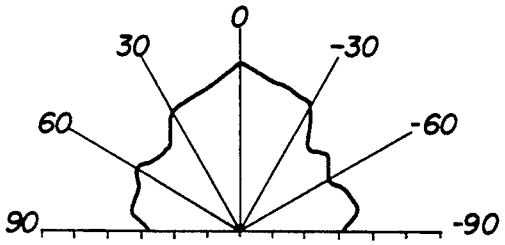
Figure 7E:
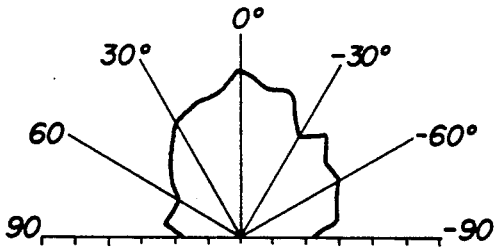
Figure 7F:
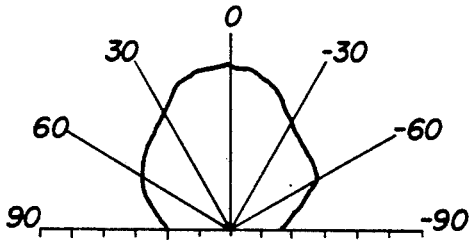

FIG. 5, drawn to scale, schematically illustrates the arrangement of elements along the rightmost portion of projections shown in FIG. 4. In FIG. 5, the direction of inclination of each of the surfaces is indicated by a triangular arrowhead, in which the point of the arrowhead indicates the direction of downward slope of the individual projection. Portion 18 in FIG. 5 indicates an empty space (which corresponds to empty space 21 of FIG. 2). As can be seen from FIG. 5, each half of a row includes eleven elements and one blank or empty space, wherein the rightmost half-row includes the space 18 while the leftmost portion of the row (which is shown in FIG. 2) includes the space 21. As discussed above, the cavities formed in the sound diffusor 10 create a structure capable of diffusing sound of various frequencies.

Figure 10:
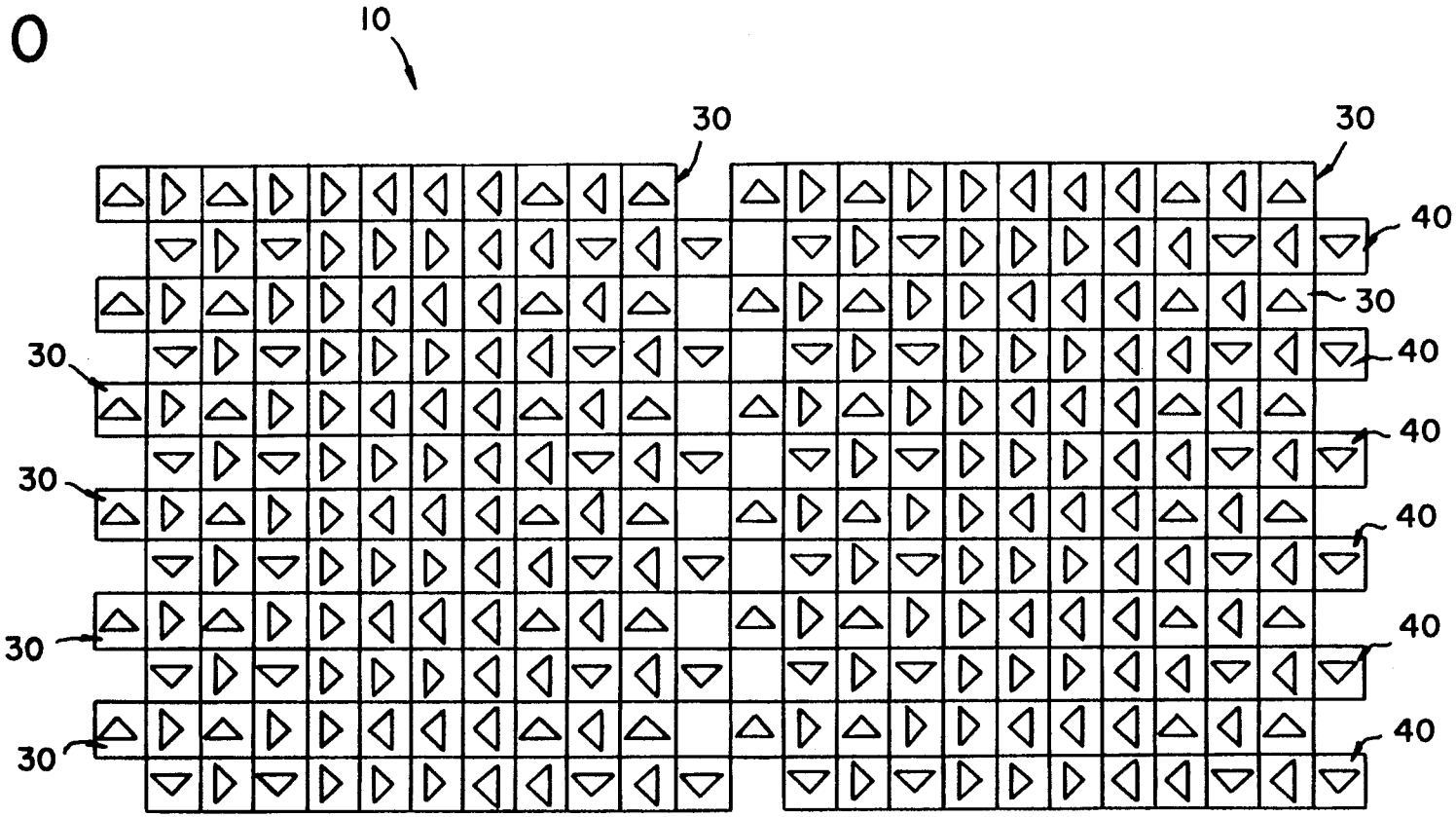
FIG. 10 is a schematic diagram indicating inclination of projections in the diffusor of FIG. 1.

FIG. 6, drawn to scale, is a schematic, top elevational view of a half section of the diffusor 10 of FIG. 1, showing the angle of inclination of each projection. As can be seen in FIG. 6, rows 30 alternate with rows 40, these rows being staggered by one space which is equivalent to the width of a projection, as discussed above. In reversing a row 30 to form a row 40, the rotation can be conceived of as being about an axis which is perpendicular to the plane of FIG. 6. As a result, a three-dimensional pattern is formed for the diffusor 10 which is capable of diffusing sound in both the horizontal and vertical directions. A second section of the device positioned to the right or left of FIG. 6 would be a portion corresponding to the rightmost portion of row 30 (i.e., that portion which is to the right of the empty space 21). This is discussed more clearly below. The sound diffusor 10 is preferably composed of two of the units shown in FIG. 6, as schematically shown in FIG. 10. The dimensions of diffusor 10 as shown in FIG. 10 are approximately thirty inches by thirty inches by nine and one-half inches (assuming the base 11 has a thickness of one-half inch). Of course, multiple dual units may be used together in numbers only limited by the dimensions of the room which includes the sound source. Such dual units can be supported by the walls defining the room.

The diffusion of sound resulting from the present invention occurs in both the horizontal and vertical directions, and is discussed as follows. FIGS. *7a–7f* are polar diagrams of sound intensity with respect to horizontal distance from the diffusor, in a range of angles measured from a perpendicular horizontal line from the center of the sound diffusor 10 through plus and minus 90°. FIG. *7a* is measured for an incident sound source located at a distance of approximately ten feet from the sound diffusor 10 and directing sound such that the sound is incident at a normal to the plane of the base 11. The position of the sound source is the same in FIGS. *7b–7f* and 8*a–*8*f*, as well. The measurements of FIG. *7a* are taken at a sound frequency of 250 Hz, FIG. *7b* is at a sound frequency of 500 Hz, FIG. *7c* is at a sound frequency of 1000 Hz, FIG. *7d* is at a frequency of 2000 Hz, FIG. *7e* is measured at a sound frequency of 4000 Hz, and FIG. *7f* is at a sound frequency of 8000 Hz. The sound frequency measurements at which diffusion is measured, as shown in *7a* and *7f*, are in increments of octaves.

Figure 8A:
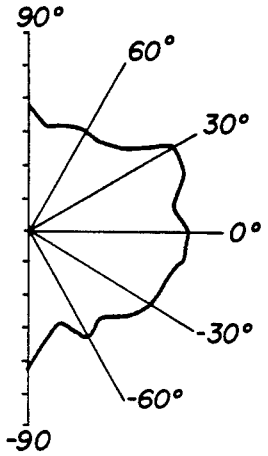
FIG. 8A–8F are vertical polar plots of the amplitude of sound waves diffused after striking the sound diffusor according to the invention, in which the initial sound wave strikes the diffusor of FIG. 1 at an angle of 0° incidence.
Figure 8B:
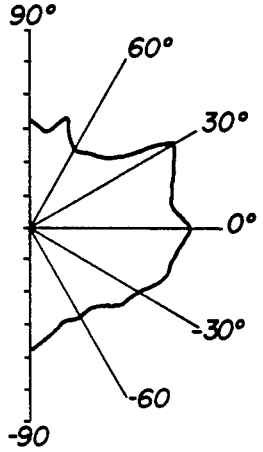
Figure 8C:
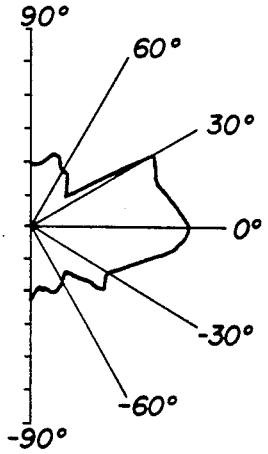
Figure 8D:
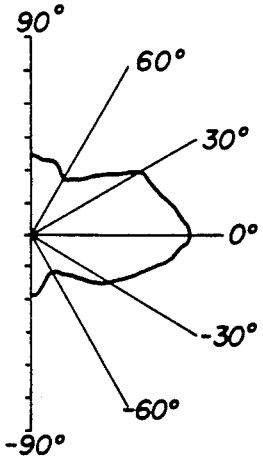
Figure 8E:
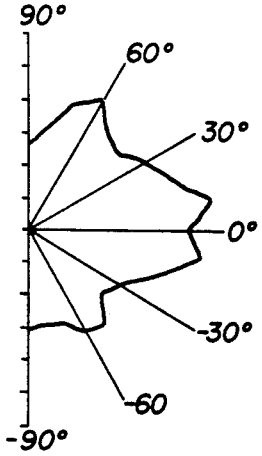
Figure 8F:
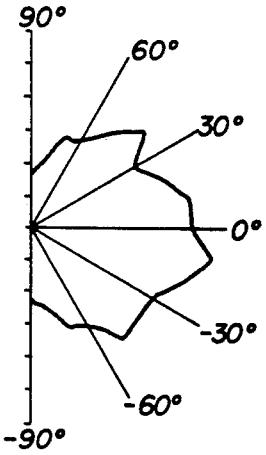

An important feature of the present invention is that it diffuses sound not only horizontally but also vertically, and this is illustrated in FIGS. 8*a–*8*f*. Polar coordinates are used, with the measurements of sound intensity being taken at a plurality of vertical angles which are in a range from plus and minus 90° from line perpendicular to the sound diffusor 10. FIGS. 8*a–*8*f* are taken at sound frequencies of 250 Hz, 500 Hz, 1000 Hz, 2000 Hz, 4000 Hz, and 8000 Hz, respectively.

In FIGS. *7a–7f* and 8*a–*8*f*, the incident sound is from a direction corresponding to zero degrees as indicated in these FIGURES (that is, as discussed above, the sound approaches from a direction which is perpendicular to the base 11).

Figure 9:
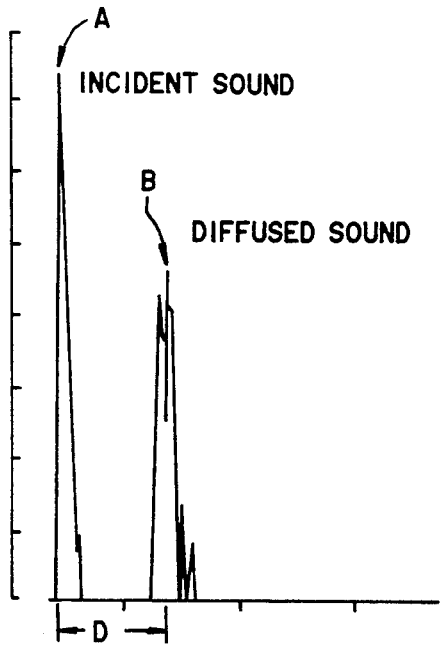
FIG. 9 is a graph of sound amplitude with respect to time respectively for a sound generated from a source, an incident sound, and sound reflected, refracted and delayed from the sound diffusor according to the invention.

FIG. 9 is a diagram of sound intensity with respect to time, indicating an incident sound wave which is separated in time from a diffused sound wave. As can be seen from this diagram, true sound diffusion occurs as a result of the effects of the sound diffusor 10 according to the invention. Peak A represents a measurement of incident sound waves measured directly from a sound source. Peak B represents measurement of diffused sound waves originally produced by the sound source, but which have come in contact with the sound diffusor of the invention positioned in front of the sound source, which is at a distance of ten feet from the diffusor 10. However, the temporal response time between these peaks is 49,862 microseconds. This time delay would be expected to be shown by sound reflected off a flat wall positioned 56 feet away from the sound source. The diffusor 10, therefore, in providing a delay in time greater than would be expected by mere reflection, makes the sound room in which the diffusor 10 is located appear to the listener to be substantially larger.

It should be apparent that many modifications may be made to the invention without departing from the spirit and scope of the invention. Therefore, the schematic diagrams and the examples of the application are only used for illustration and direction. The invention is limited only in scope by the appended claims.

What is claimed is:

1. A sound diffusor for diffusing sound in two dimensions, comprising:

a plurality of wells of different widths and depths, said wells being defined by a matrix of a plurality of projecting elements of different heights, said projecting elements being arranged in a plurality of parallel rows, a plurality of the projecting elements having a terminating projecting end and the terminating projecting ends of the projecting elements being angled at between 1 to 20°.

2. The sound diffusor of claim 1 wherein each projecting element has a base, and the base of every element is of equal dimension.

3. The sound diffusor of claim 1 wherein each of the plurality of rows contains at least two open spaces.

4. The sound diffusor or claim 1 wherein the height of each projecting element is divisible by a common multiple.

5. A sound diffusor capable of two dimensional sound diffusion, comprising:

a plurality of wells of different widths and depths, said wells being defined by a matrix of a plurality of projecting elements of a plurality of different heights, a plurality of the projecting elements having a terminating projecting end, the projecting ends being angled between 1° and 20° and positioned at the bottom of a well, said projecting elements being arranged in parallel rows.

6. The sound diffusor of claim 5 wherein the height of each projecting element is divisible by a common multiple.

7. The sound diffusor of claim 5 wherein a row of projecting elements is composed of twenty-two projecting elements and two spaces devoid of projecting elements.

8. The sound diffusor of claim 5 wherein the terminating end of each projecting element is angled at 10°.

9. A sound diffusor capable of two dimensional sound diffusion comprised of a matrix of projecting elements of varied heights and void spaces, said elements and void spaces defining wells of different widths and depths, each projecting element having a base and a terminating end, said terminating end being angled at between 1° and 20° and said matrix is comprised of a plurality of parallel rows of the projecting elements and void spaces.

10. The sound diffusor of claim 9 wherein a first row of projecting elements and void spaces is arranged in the following order Z, 2x, x, 5x, 4x, 3x, 6x, 3x, 4x, 5x, x, and 2x and the pattern is repeated in the order shown to complete the row, x is a constant and is multiplied by the number shown to obtain the relative height of a projecting element and Z is a void space, and a second row of projecting elements and void spaces is arranged in the following order 2x, x, 5x, 4x, 3x, 6x, 3x, 4x, 5x, x, 2x and Z and the pattern is repeated to complete the row, Z and X have the meaning defined above, the remaining rows of the matrix alternate between the pattern described for the first row and the pattern described for the second row.

11. The sound diffusor of claim 10 wherein X=1.5.

12. A sound diffusor for diffusing sound in two dimensions, comprising:

a plurality of wells of different widths and depths, said wells being defined by a matrix of a plurality of projecting elements having a base and a projecting end, the projecting ends positioned at the bottom of a well have an incline of between 1° and 20° relative to a plane perpendicular to the longitudinal axis of the projecting elements, said projecting elements being arranged in parallel rows, and divisible by a common multiple.

13. The sound diffusor of claim 12, wherein a slope of the incline of a first projecting element faces in a direction different from the slope of a second, third and fourth projecting element.

* * * * *